US007859477B2

(12) United States Patent
Birnbaum et al.

(10) Patent No.: US 7,859,477 B2
(45) Date of Patent: Dec. 28, 2010

(54) J-POLE ANTENNA

(75) Inventors: Thomas Birnbaum, Santa Cruz, CA (US); Brad Gilbert, Burlingame, CA (US); Thomas Mabry, San Jose, CA (US)

(73) Assignee: Silver Spring Networks, Inc., Redwood City, CA (US)

( * ) Notice: Subject to any disclaimer, the term of this patent is extended or adjusted under 35 U.S.C. 154(b) by 535 days.

(21) Appl. No.: 11/731,797

(22) Filed: Mar. 30, 2007

(65) Prior Publication Data

US 2009/0102737 A1 Apr. 23, 2009

(51) Int. Cl.
*H01Q 9/38* (2006.01)

(52) U.S. Cl. ..... 343/830; 343/828

(58) Field of Classification Search ..... 343/931, 343/825, 826, 827, 828, 829, 820
See application file for complete search history.

(56) References Cited

U.S. PATENT DOCUMENTS

| | | | | |
|---|---|---|---|---|
| 2,124,424 | A | 7/1938 | Leeds | |
| 4,209,790 | A * | 6/1980 | Newcomb | 343/830 |
| 4,644,364 | A * | 2/1987 | Parks | 343/825 |
| 6,642,899 | B2 * | 11/2003 | Strickland et al. | 343/773 |
| 6,677,905 | B2 * | 1/2004 | Deguchi et al. | 343/702 |
| 2003/0016177 | A1 | 1/2003 | Deguchi et al. | |

FOREIGN PATENT DOCUMENTS

WO WO 98/39814 A 9/1998

OTHER PUBLICATIONS

Michael Heiler, A Backpacker's Delight—The Folding J-Pole, Mar. 2005, QST Magazine, vol. 89, No. 3.*
International Search Report dated Jul. 11, 2008 in PCT/US2008/004159.

* cited by examiner

*Primary Examiner*—Douglas W Owens
*Assistant Examiner*—Kyana R Robinson
(74) *Attorney, Agent, or Firm*—Buchanan Ingersoll & Rooney PC

(57) ABSTRACT

A J-Pole antenna disclosed including: shunt segment extending out of the plane of the J-Pole antenna. A shunt segment extending out of the plane of the J-pole antenna aids in attaching the antenna to a connector and allowing for a reduction in the size of the antenna and connector. The shunt segment also makes the antenna shorter while preserving the same gain and impedance performance as a conventional J-Pole antenna. A connector plate and connector may be used with the antenna having the shunt segment extending out of the plane of the J-Pole antenna. A protective enclosure may be used with the J-Pole antenna and allowing a radiating antenna segment of the J-Pole antenna to extend from the protective enclosure.

21 Claims, 13 Drawing Sheets

IMAGES OF FOLDED MATCHING SECTION

J-POLE ANTENNA

FIELD OF THE INVENTION

The field of the invention relates generally to radio frequency (RF) devices and antennas for use with RF devices.

BACKGROUND OF THE INVENTION

A conventional J-pole antenna is an omnidirectional antenna that can be used for base, mobile and field day stations. It does not need a ground plane, radials or a complicated matching system.

A Conventional J-Pole design illustrated in FIG. 1. The J-Pole antenna 100 includes of a radiating antenna segment 101 and a quarter-wave matching segment 102. A feed line 103 connects to the radiating antenna segment. The matching segment 104 is connected to ground. The connection points on the J-Pole antenna between the feed line and ground are chosen to provide sufficient resistance to prevent shorting between the feed line and the ground. In a conventional J-Pole antenna, the shunt segment 105 is formed to extend down below to connection points. Typically, the length A of the radiating antenna segment 101 is ½ the wavelength of the frequency the antenna is designed to operate at. Typically, the length B of the matching segment 102 is ¼ the wavelength the antenna is designed to operate at.

Conventional J-pole antennas are made of a conductive tubing, such as copper or aluminum. There are versions made of 300-ohm TV twin lead, which can be rolled up easily into a small package.

SUMMARY

A J-Pole antenna has a radiating antenna segment, a matching segment, and a shunt segment, where the shunt segment is positioned not to extend away and down from the connection points of a feed line and ground to the J-Pole antenna. Additional embodiments may include a connector and/or connector plate. the connector may be a co-axial type connector.

BRIEF DESCRIPTION OF THE DRAWINGS

FIG. 2(*b*) is a detailed perspective view of a J-pole antenna and connector, according to one possible embodiment.

FIG. 2(*c*) is an alternate detailed perspective view of a J-pole antenna and connector, according to one possible embodiment.

FIG. 2(*d*) is a side view of a J-pole antenna and connector, according to one possible embodiment.

FIG. 2(*e*) is a side view of a J-pole antenna and connector, according to one possible embodiment.

FIG. 3(*b*) is a cross sectional view of a telescoping J-pole antenna and connector with an antenna housing, according to one possible embodiment.

FIG. 3(*c*) is a cross sectional view of a sectional J-pole antenna and connector with an antenna housing, according to one possible embodiment.

FIG. 3(*d*) is a cross sectional view of a folding J-pole antenna and connector with an antenna housing, according to one possible embodiment.

FIG. 3(*e*) is a perspective view of an antenna housing illustrating the radiating antenna segment opening, according to one possible embodiment.

FIG. 3(*f*) is a perspective view of an antenna housing illustrating the connecting flange and protective enclosure, according to one possible embodiment.

FIG. 4(*b*) is a cross sectional view of a sectional J-pole antenna and connector with a device housing, according to one possible embodiment.

FIG. 4(*c*) is a cross sectional view of a folding J-pole antenna and device housing, according to one possible embodiment.

DETAILED DESCRIPTION OF THE INVENTION

Figure 1:
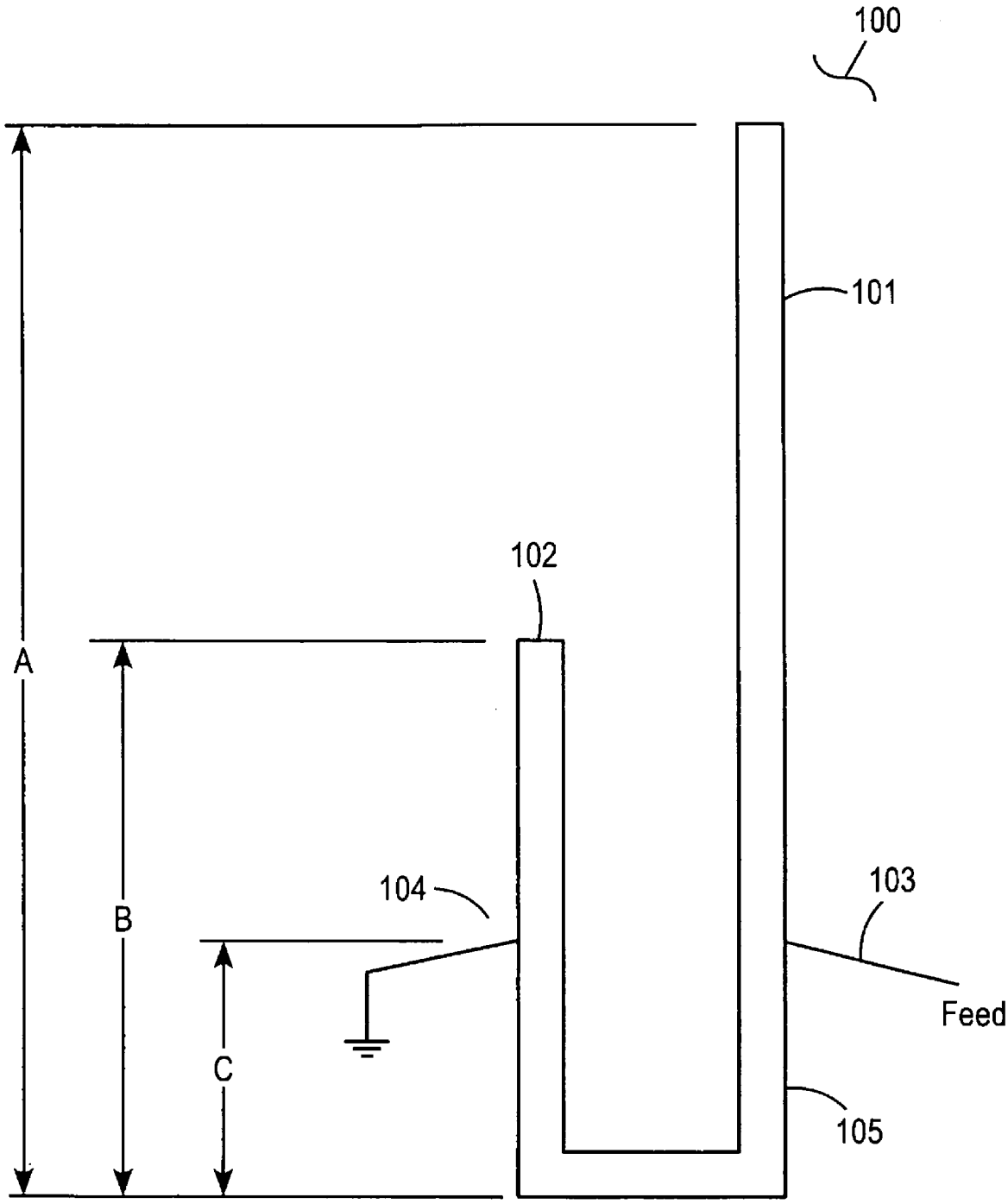
(Prior Art) FIG. 1
FIG. 1 is a generalized diagram illustrating a conventional J-pole type antenna.
Figure 2A:
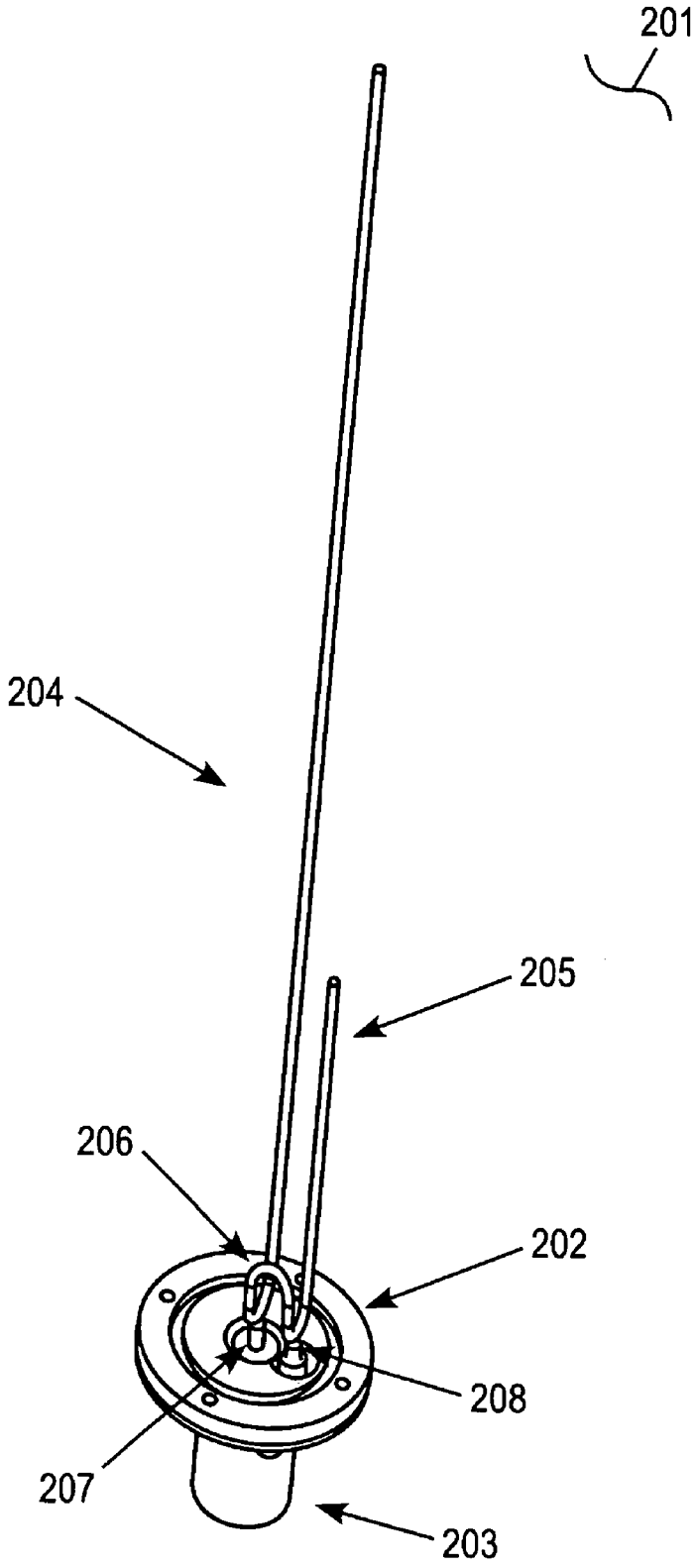
FIG. 2(*a*) is a perspective view of a J-pole antenna and connector, according to one possible embodiment.
Figure 2B:
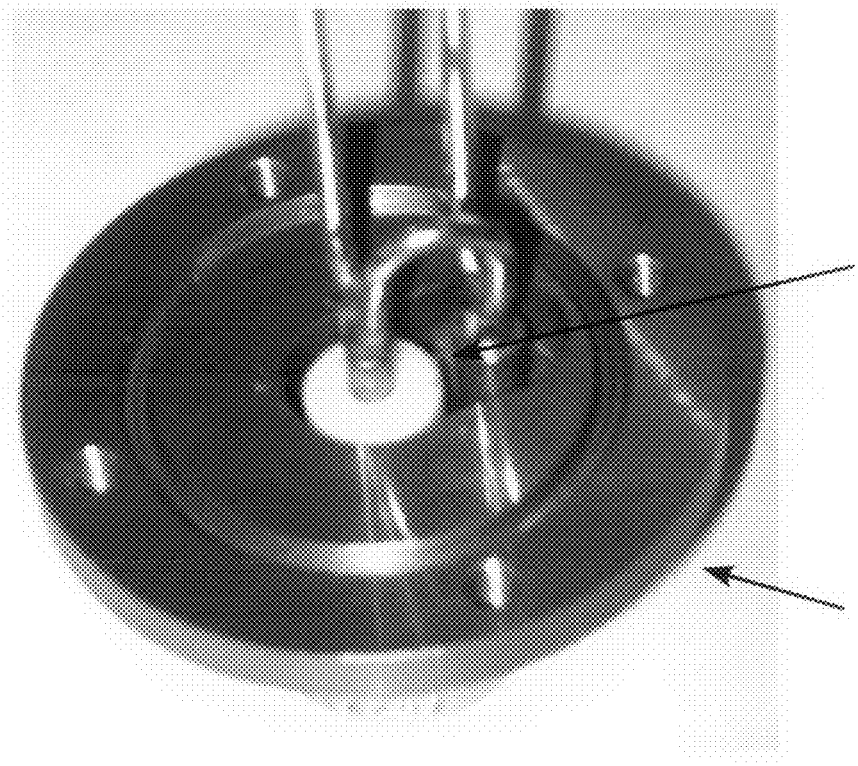
Figure 2C:
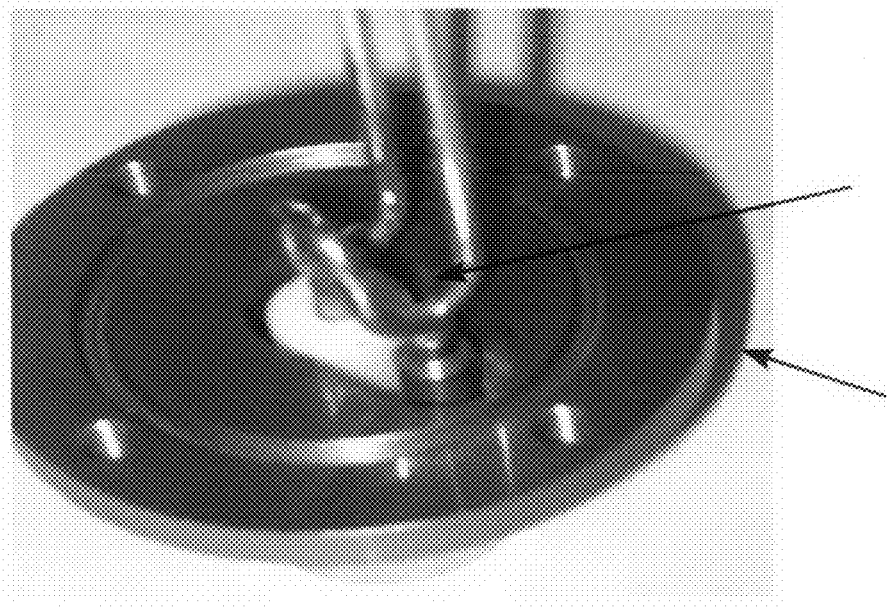
Figure 2D:
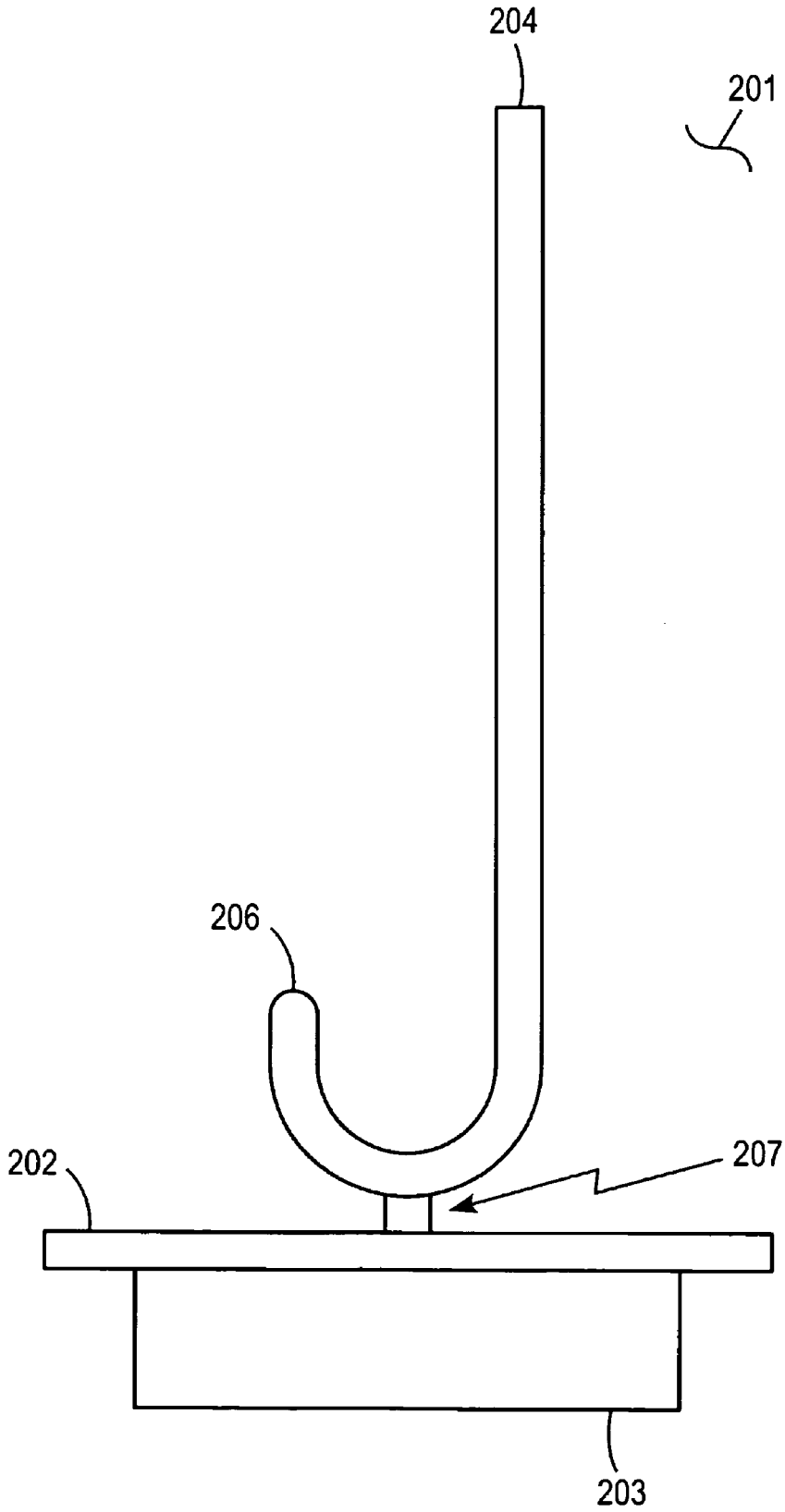
Figure 2E:
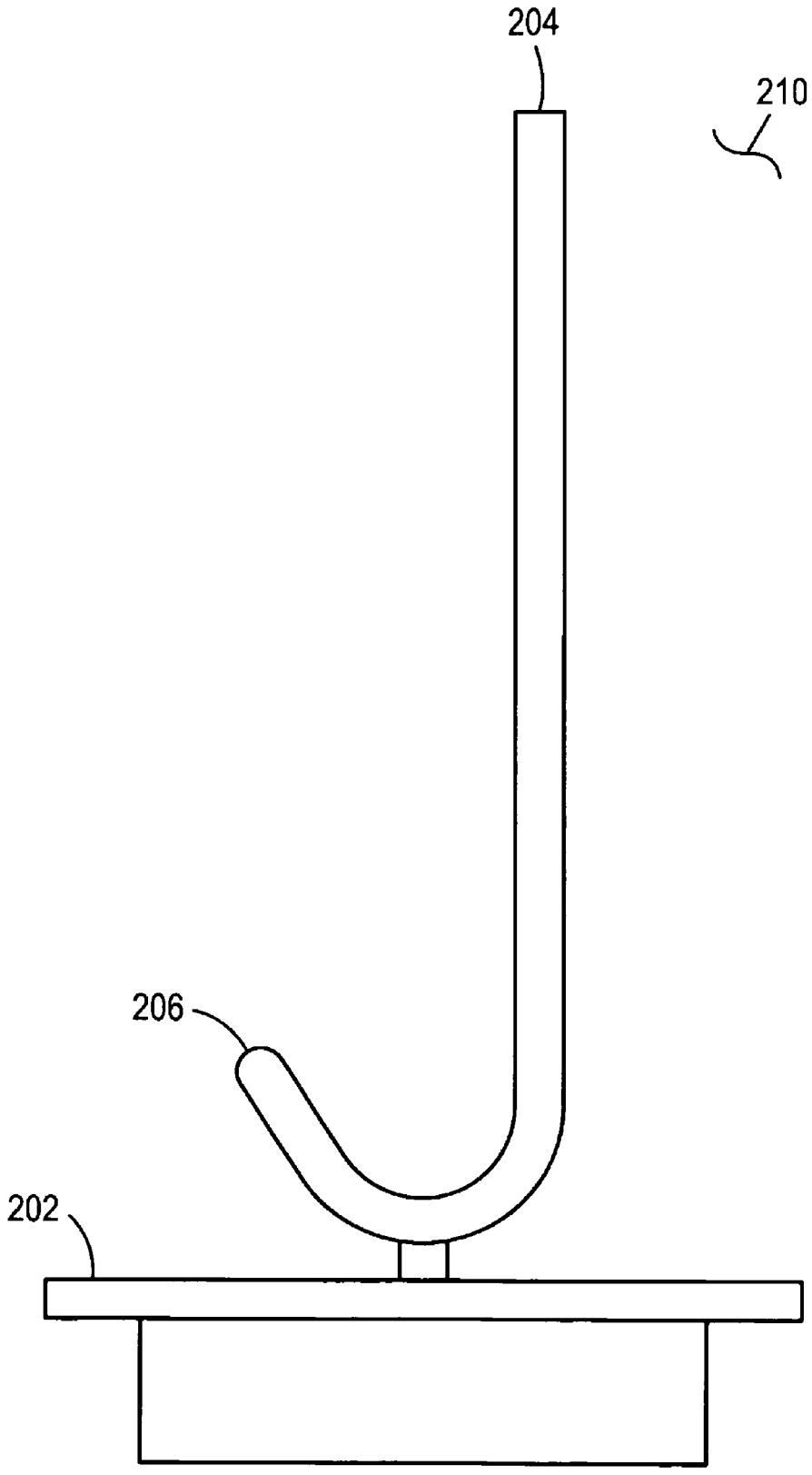
Figure 3A:
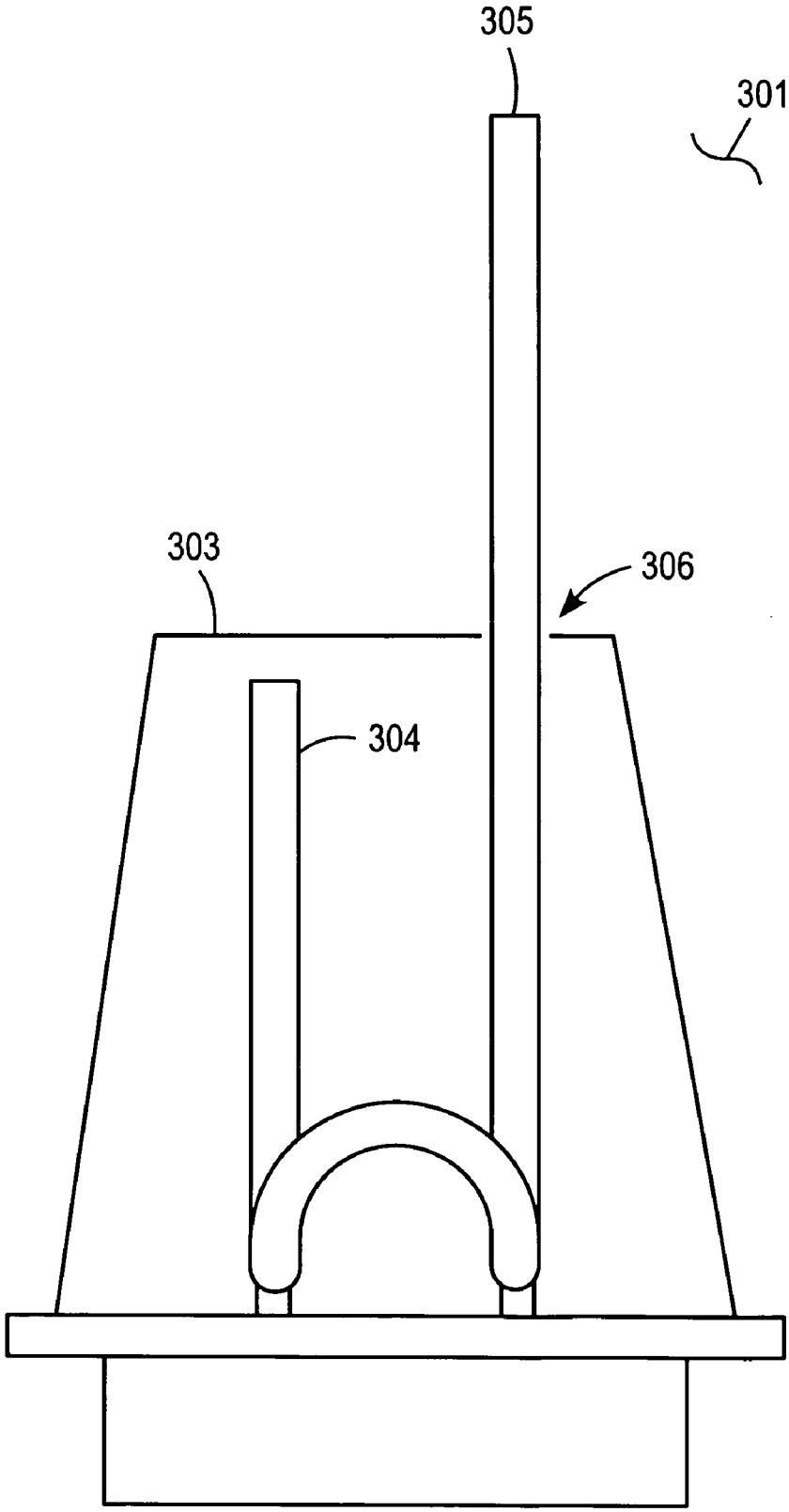
FIG. 3(*a*) is a cross sectional view of a J-pole antenna and connector with an antenna housing, according to one possible embodiment.
Figure 3B:
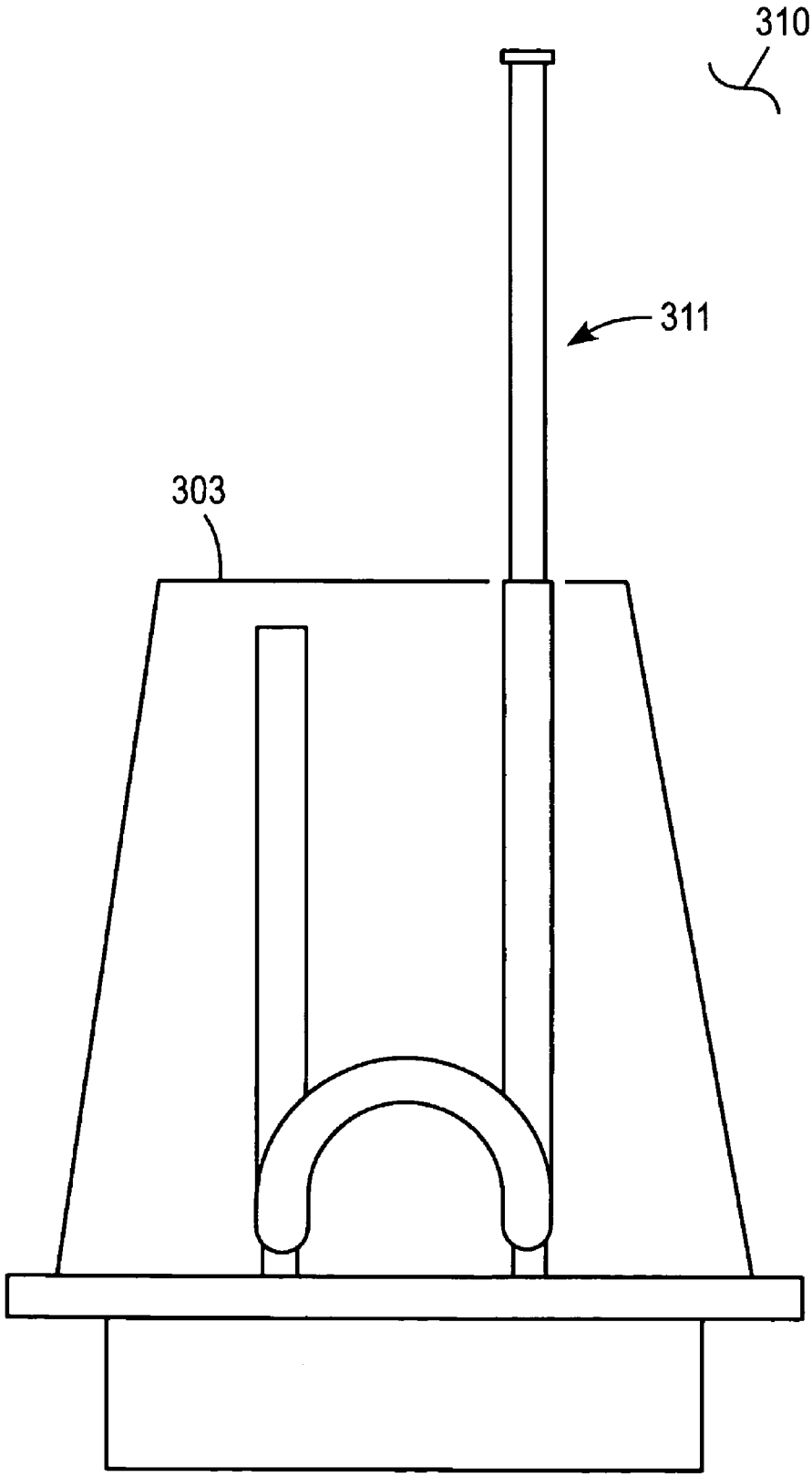
Figure 3C:
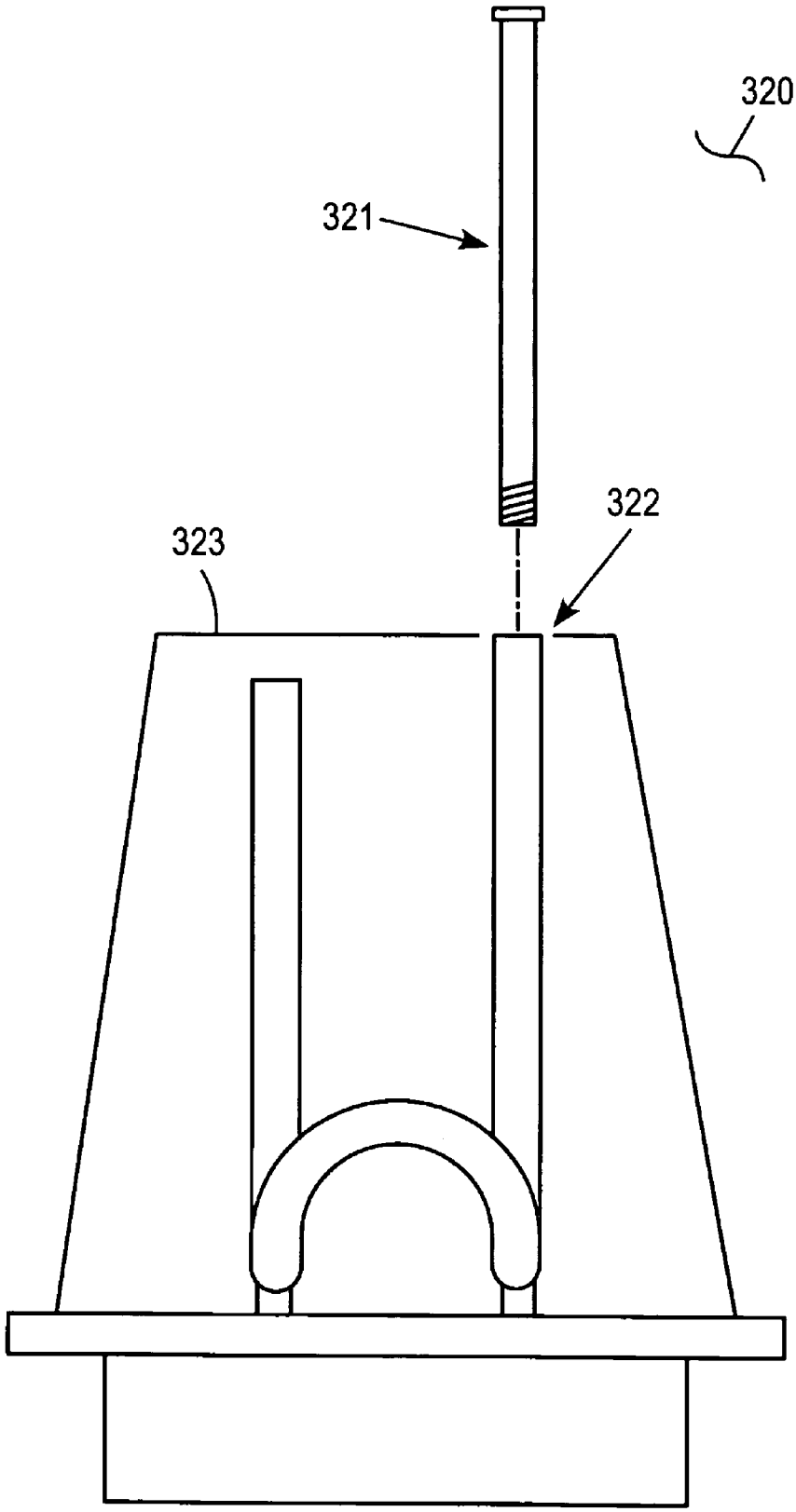
Figure 3D:
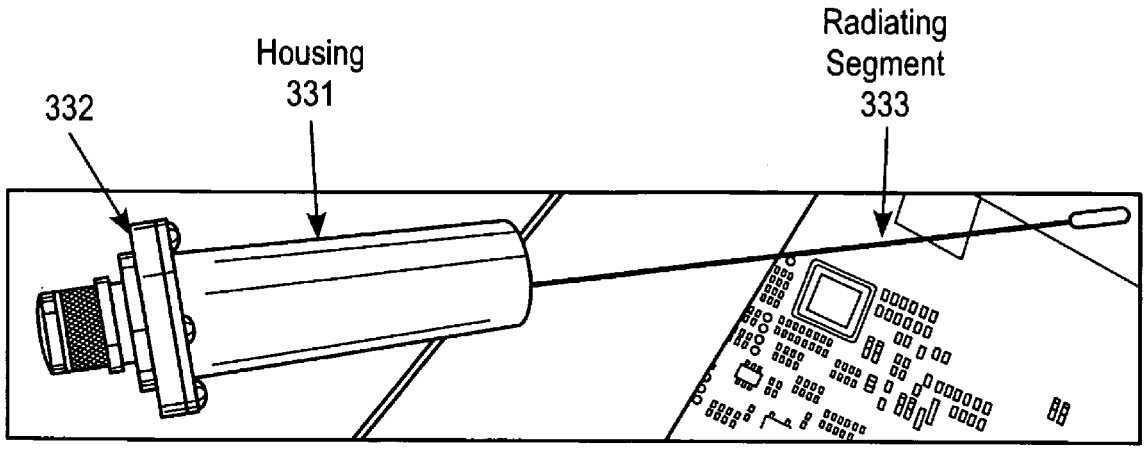
Figure 3E:
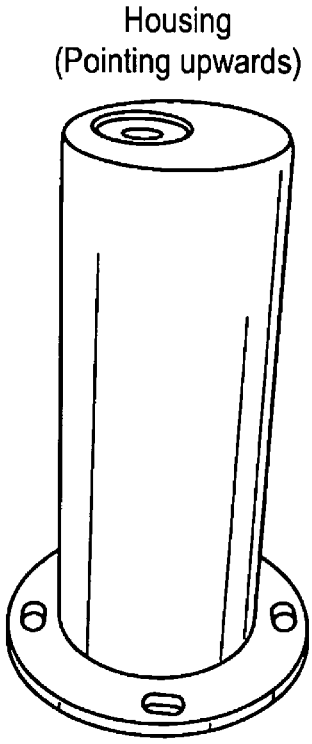
Figure 3F:
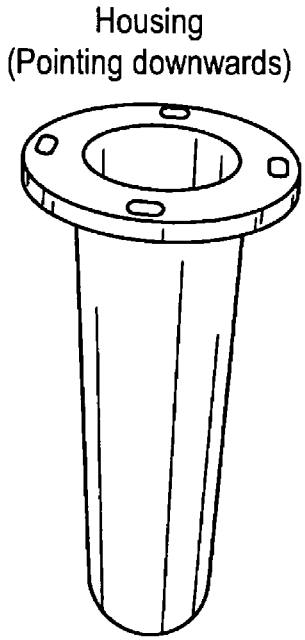

FIG. 2(*a*) is a perspective view of a preferred embodiment of J-Pole antenna 201, connector plate 202 and connector 203. The J-Pole antenna 201 includes a radiating antenna segment 204 (also referred to as the radiating segment), a matching segment (or matching stub) 205, and a shunt segment 206. The J-Pole antenna 201 is structurally and electrically connected to the connector 203. The connector 203 is connected to the base plate 202. In the preferred embodiment the base plate 202 is made from a conductive material, such as a metal, for example, without limitation, aluminum, copper or steel. In one presently preferred embodiment, the connector includes, or is, a coaxial type connector. Unless otherwise noted, the term connector may include a connector housing which provides a secure connection between the antenna and a connector and/or a mounting system. As is known to those skilled in the art, the matching segment (¼ wavelength bottom portion) does not radiate, only the radiating segment 204 radiates, and should be either fully exposed or housed in a random type of enclosure, so as not to block the transmitted or received signals As with conventional J-Pole antennas, the antenna 201 uses a matching segment 205 which is shorter than the radiating segment 204. In one preferred embodiment the matching segment 205 is ½ the length of the radiating segment. Alternate embodiments may use other detentions for either the radiating or matching segments. In one preferred embodiment the matching segment and radiating segment of the antenna are formed from conductive tubing. Examples of materials that may be used for the conductive tubing include conductive metals like copper and aluminum, but any conductive or partially conductive material capable receiving or transmitting RF signals may be used. Alternate embodiments may have the either, or both, the radiating segment and the matching segment formed form a material in a shape other than a tubing. In one preferred embodiment the radiating segment 204 has a length of ½ the wavelength of the corresponding frequency the antenna is designed to operate at. In one preferred embodiment the matching segment 205 has a length of ¼ the wavelength of the corresponding frequency the antenna is designed to operate at. While the preferred embodiment has the radiating segment of the antenna has a length of ½ the wavelength and the matching segment has a length of ¼ the wavelength of the corresponding frequency the antenna is designed to operate at, alternate embodiments may use a different length for either the radiating segment or the matching segment.

As shown in FIG. 2(*d*) the radiating segment is positioned on the left relative to the bent ¼ wavelength stub of the matching segment and on top of the non-radiating part of the matching segment, as viewed from the perspective of the shunt segment. However, alternate embodiments may have different relative positions for the radiating segment, matching segment and shunt segment.

FIG. 2(*b*) and FIG. 2(*c*) are perspective views illustrating details of the shunt segment 206 and attachment of the antenna J-Pole 201 to the connector 203. As shown in FIG. 2(*a*) and further illustrated in FIGS. 2(*b*) and 2(*c*), shunt segment 206 is formed to not extend below the electrical connection points between the J-Pole antenna and connector. In the illustrated embodiment, the shunt segment 206 is formed as a loop and extends away from the connector base plate plane 202 to be substantially parallel to the plane formed by the radiating segment 204 and matching segment 205. In the illustrated embodiment, the radiating segment 204, the matching segment 205 and the shunt segment 206 are formed from a single piece of conductive tubing. In such an embodiment the shunt segment 206 may be formed from bending the tubing to create a shunt segment at the feed and ground connecting points 207 and 208 at the bottom of the two sections of the matching segment, and such that the shunt segment 206 is substantially parallel to the plane formed from the radiating segment 204 and matching segment 205. In the presently preferred embodiment, the connecting points 207 and 208 between the J-Pole antenna and the feed line and ground line respectively of the connector are both structural and electrical connections. As illustrated, the connections are by welding or soldering the J-Pole antenna to feed line and ground line of the connector. Alternate embodiments may use other ways of connecting the J-Pole antenna to the connector, including clamps, screws, clips, or another type of attachment system. In another alternative embodiment the structural attachment between the J-Pole antenna and the connector may be separate from the electrical connection between the antenna and the connector.

While the embodiment discussed has the radiating segment of the antenna, the matching segment and the shunt segment are formed from a single conductive material, alternate embodiments may be formed from different pieces of conductive material. Additionally, alternate embodiments may have the radiating segment, the matching segment and/or the shunt segment formed from different materials. For example, the shunt segment may be formed from a material of higher resistance than the materials of either, or both, the radiating segment and the matching segment.

FIG. 2(*c*) and FIG. 2(*d*) illustrate the shunt segment 206 formed as a loop segment between the feed line 207 and ground connection 208 of J-Pole antenna 201. FIG. 2(*d*) is a side view of the J-Pole antenna 201 illustrating the shunt segment formed to extend substantially parallel to the radiating segment and the matching segment. In the embodiment shown in FIG. 2(*d*) the feed line connection 207 is shown, and from the perspective in FIG. 2(*d*) the ground connecting point is positioned behind, and obscured by, the feed line connection 207.

FIG. 2(*e*) is a side view of a J-Pole antenna 210 having a shunt segment positioned away from parallel to the radiating segment 204. As illustrated shown, J-Pole antennas 201 and 210 illustrate, the shunt segment may be formed to extend away from the connecting points in any number of positions, thereby allowing for shortening of the overall length of the J-Pole antenna. Other embodiments may have the shunt segment formed to be parallel to the connector plate. Still other embodiments of the J-Pole antenna may extend below the connection point of the feed line and the ground, at varying angles form directly below. In the embodiment shown in 2(*e*) the feed line connection 207 is shown, and from the perspective in FIG. 2(*e*) the ground connecting point is positioned behind, and obscured by, the feed line connection 207.

FIG. 3(*a*) is a front view of a J-Pole antenna 301 with a connector 302, having an antenna housing 303 illustrating the positioning of the matching segment 304. The antenna housing 303 is shown in cut-away form to illustrate the relative positioning of the J-Pole antenna to the antenna housing. In the presently preferred embodiment, the antenna housing is chosen to provide protection to the matching segment while still providing a, relatively, compact housing. The radiating segment of the antenna 305 extends through the opening 306 in the antenna housing.

FIG. 3(*b*) is a front view of a J-Pole antenna 310 with a telescoping radiating segment section 311. As shown, the telescoping section is in the extended position. In the closed position (not shown) the telescoping allows the radiating segment to retract substantially to reduce the exposure of radiating segment from the environment, when the antenna is not in use or not radiating. In one preferred embodiment, the radiating segment retracts such that the tip of the radiating segment is substantially parallel to the outer surface of the antenna housing 303. The tip of the radiating segment may have a tight nylon, rubber, or plastic cap that fits snugly into the hole of the antenna housing so as to provide a water-proof tight cover when the radiating segment is retracted inwards all the way. While the example radiating segment shown is simply one telescoping segment, alternate embodiments may have any number of telescoping segments.

FIG. 3(*c*) is a front view of a J-Pole antenna 320 having a radiating segment 321 as a separable segment 322. The separable segment may be disconnected from the rest of the J-Pole antenna, thus reducing the chances of damage to the J-Pole antenna, for example during transportation or installation of the J-Pole antenna. The separable segment may attach to the rest of the J-Pole antenna by any means which provides secure electrical and structural contact. In one preferred embodiment the separable segment is attachable by screw threads, for example by screwing the threaded end of the separable segment into a threaded end of the rest of the J-Pole antenna. The J-Pole antenna may also include an antenna housing 323. The length of the separable segment may be chosen such that the rest of the J-Pole antenna is protected by the antenna housing 323 when the separable segment is not attached. In any event, the separable segment, at a minimum, may include the complete radiating segment. The separable segment may also be provided housing in the form of a cylindrical hollow tubing on the side of the antenna housing (attached or detached) where the separable segment can be stored, in closed or open condition with or without a lid.

FIG. 3(*d*) is a perspective view of a J-Pole antenna 330 having an antenna housing (also referred to as the 'enclosure") 331 installed and attached to the connector base 332. The radiating segment 333 extends from the antenna housing 331.

FIG. 3(*e*) is a perspective view of an antenna housing 331 illustrating the radiating segment opening. In the preferred embodiment the antenna housing is formed from a non-conductive material, such as a plastic or nylon. However, alternate embodiments may use any material which provides the desired level of protection and allows operation of the J-Pole antenna.

FIG. 3(*f*) is a perspective view of an antenna housing 331 illustrating the connecting flange. In the presently preferred embodiment, the protective enclosure is sized to cover the matching segment and shunt segment. While the connecting flange is used to connect to the connector base via multiple screws or bolts, alternate embodiments could use other attachment mechanisms.

Figure 4A:
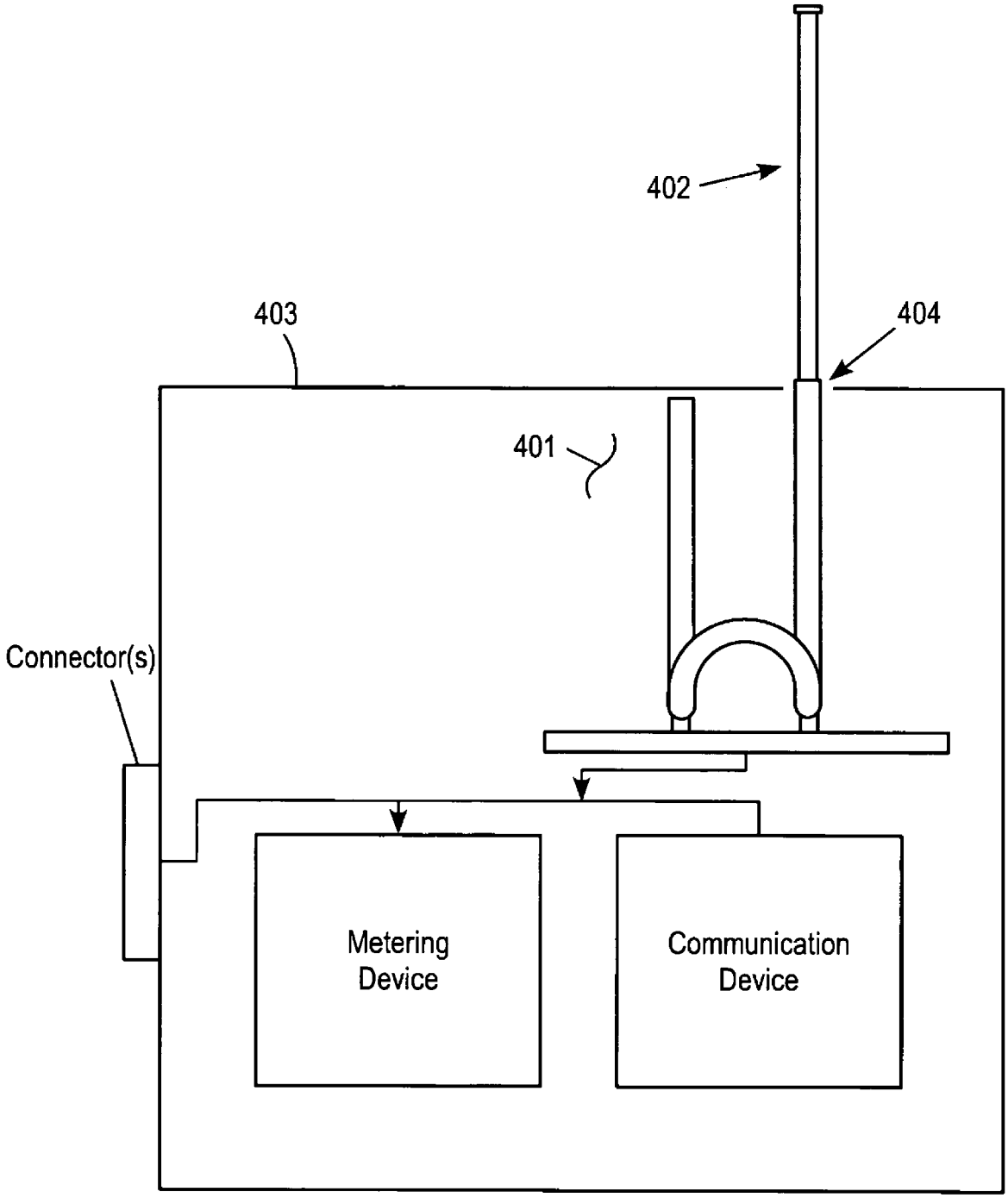
FIG. 4(*a*) is a cross sectional view of a telescoping J-pole antenna and connector with a device housing, according to one possible embodiment.
Figure 4B:
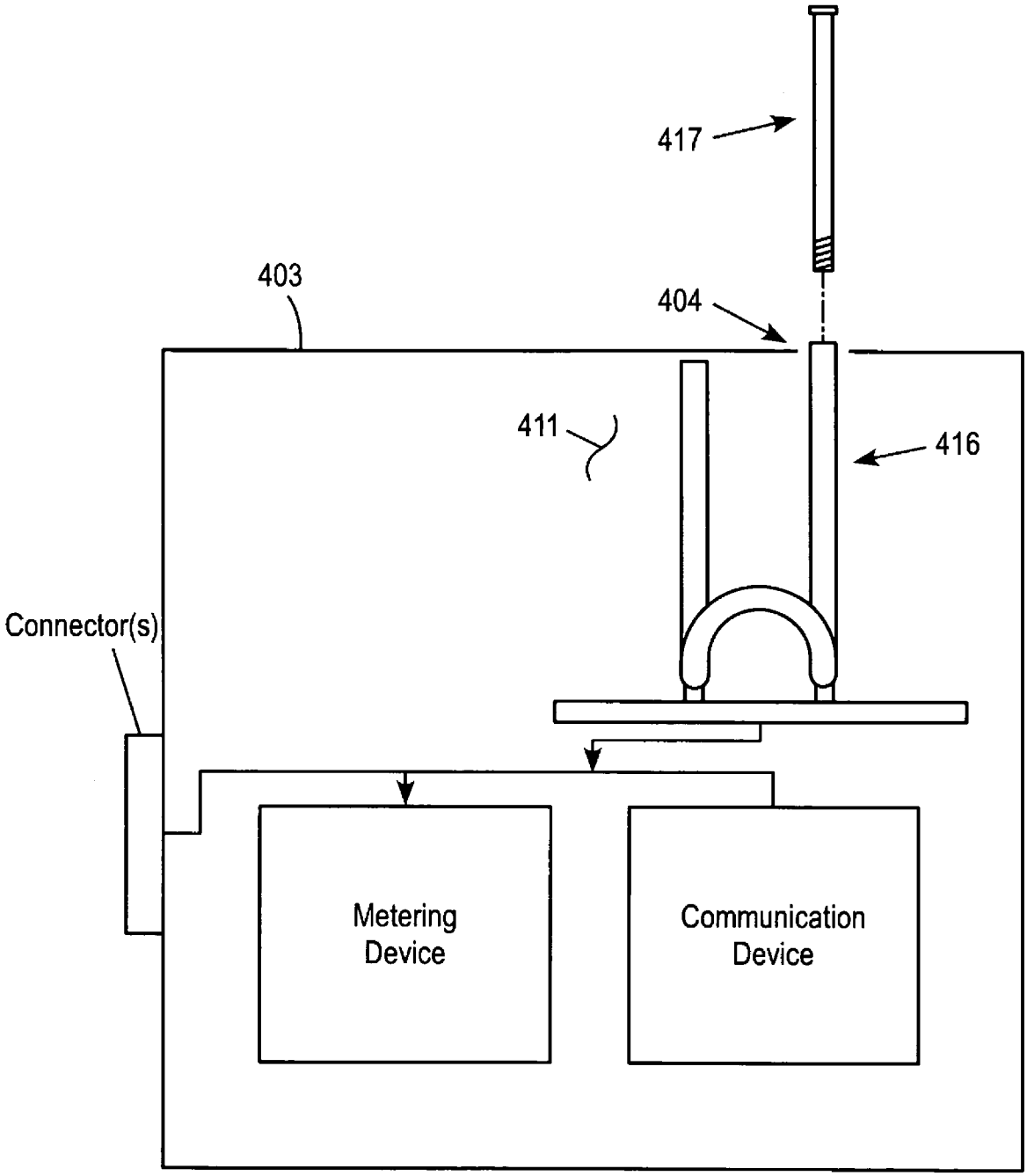
Figure 4C:
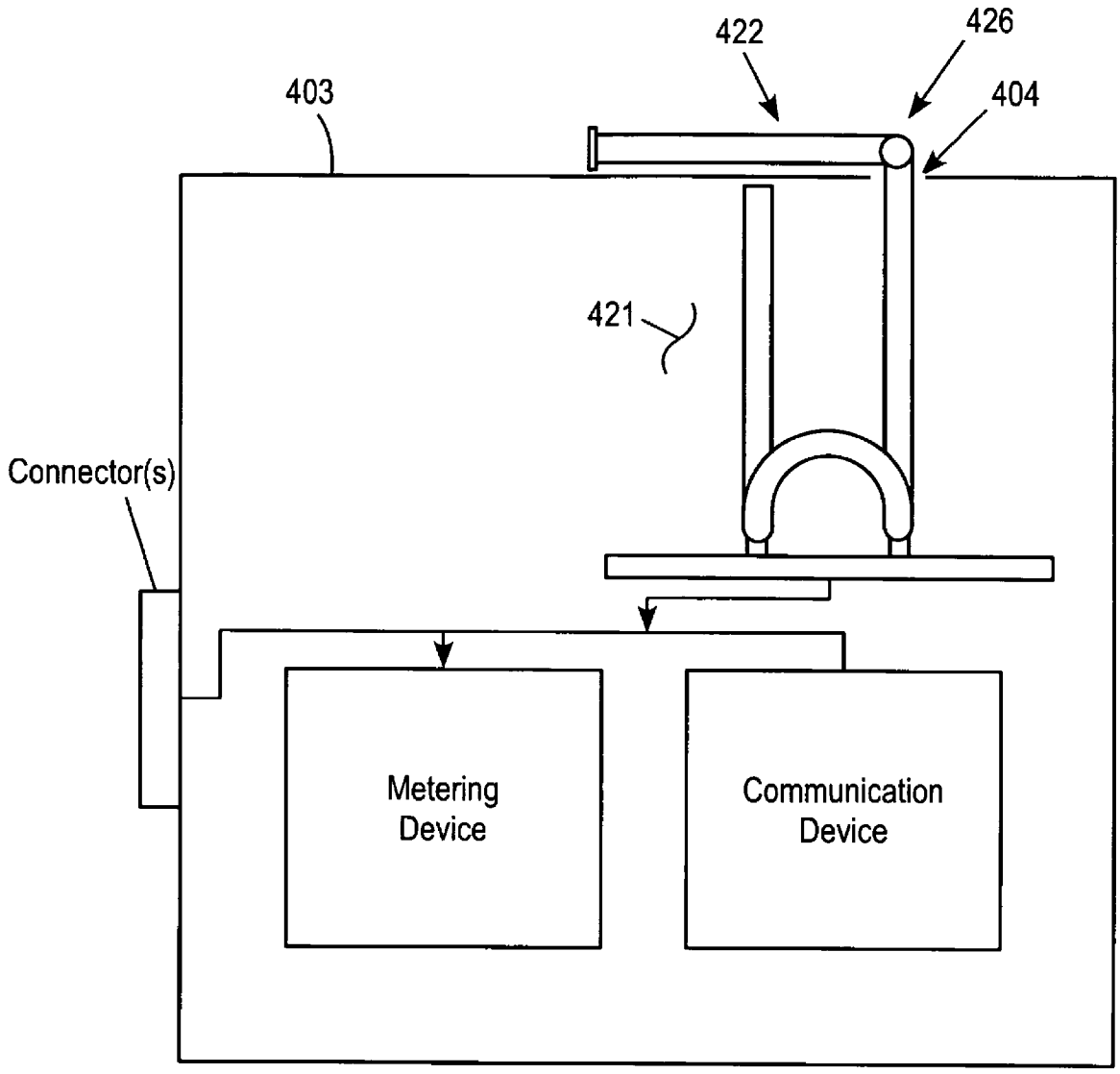

FIG. 4(*a*) is a front view of a J-Pole antenna 401 having a radiating segment 402 extending from an electronic device enclosure 403 through a radiating segment opening 404. The electronic device enclosure 403 is shown in cut-away to illustrate the positioning of electronic device (or devices) and the J-Pole antenna relative to the electronic device enclosure. In the presently preferred embodiment, the electronic device enclosure is formed to enclose and protect electronic devices. For example, the electronic device enclosure may provide protection to electronic devices from the J-Pole antenna segments. The electronic device enclosure may be formed from any material which provides the appropriate protection and/or electronic properties to allow operation of the J-Pole antenna and/or electronic device(s). J-Pole antenna may include a telescoping radiating segment 402, as show in the extended position, to allow the radiating segment to retract to be protected by the electronic device enclosure, for example during transportation or installation. As shown, electronic device enclosure encloses a commodity meter, a communication device and connector, as may be found in an automated metering network. However, the electronic device enclosure may include or be designed to include any type, number or arrangement of electronic devices. For example, the electronic device enclosure may be housing an RF transceiver, digital controller, signal processor, modem, and other, as typically found in many field RF systems such as relays, gateways, nodal remote RF devices, etc. of any type of wireless and fixed RF networks FIG. 4(*b*) is a front view of a sectional J-pole antenna 411 having a matching segment 416 with a separable radiating segment 417. The separable segment may be disconnected from the rest of the J-Pole antenna, thus reducing the chances of damage to the J-Pole antenna, for example during transportation or installation of the J-Pole antenna. The separable segment may attach to the rest of the J-Pole antenna by any means which provides secure electrical and structural contact. In one preferred embodiment the separable segment is attachable by screw threads, for example by screwing the threaded end of the separable segment into a threaded end of the rest of the J-Pole antenna. The J-Pole is installed in an electronic device housing 403. The J-pole antenna 411 is positioned within the device housing such that the separable radiating segment 417 may be attached to the rest of the J-Pole antenna through a radiating segment opening 404.

FIG. 4(*c*) is a front view of a J-Pole antenna 421 having a radiating segment 422 with a pivot (conducting) joint 426. In the preferred embodiment, J-Pole antenna 421 having the radiating segment 422 with the pivot joint 426 extends from an electronic device enclosure 403 through a radiating antenna opening 404. In the preferred embodiment, the pivot point and J-Pole antenna are positioned to allow the radiating segment to be positioned substantially parallel to the outside of the electronic device enclosure when in stowed position and swung into position upwards (or downwards) in any direction to obtain the desired antenna radiating characteristics. While the preferred embodiment has the radiating segment with pivot joint used with an electronic device enclosure, alternate embodiments could be used with an antenna housing, or alone without an antenna-housing or an electronic device enclosure.

Figure 5:
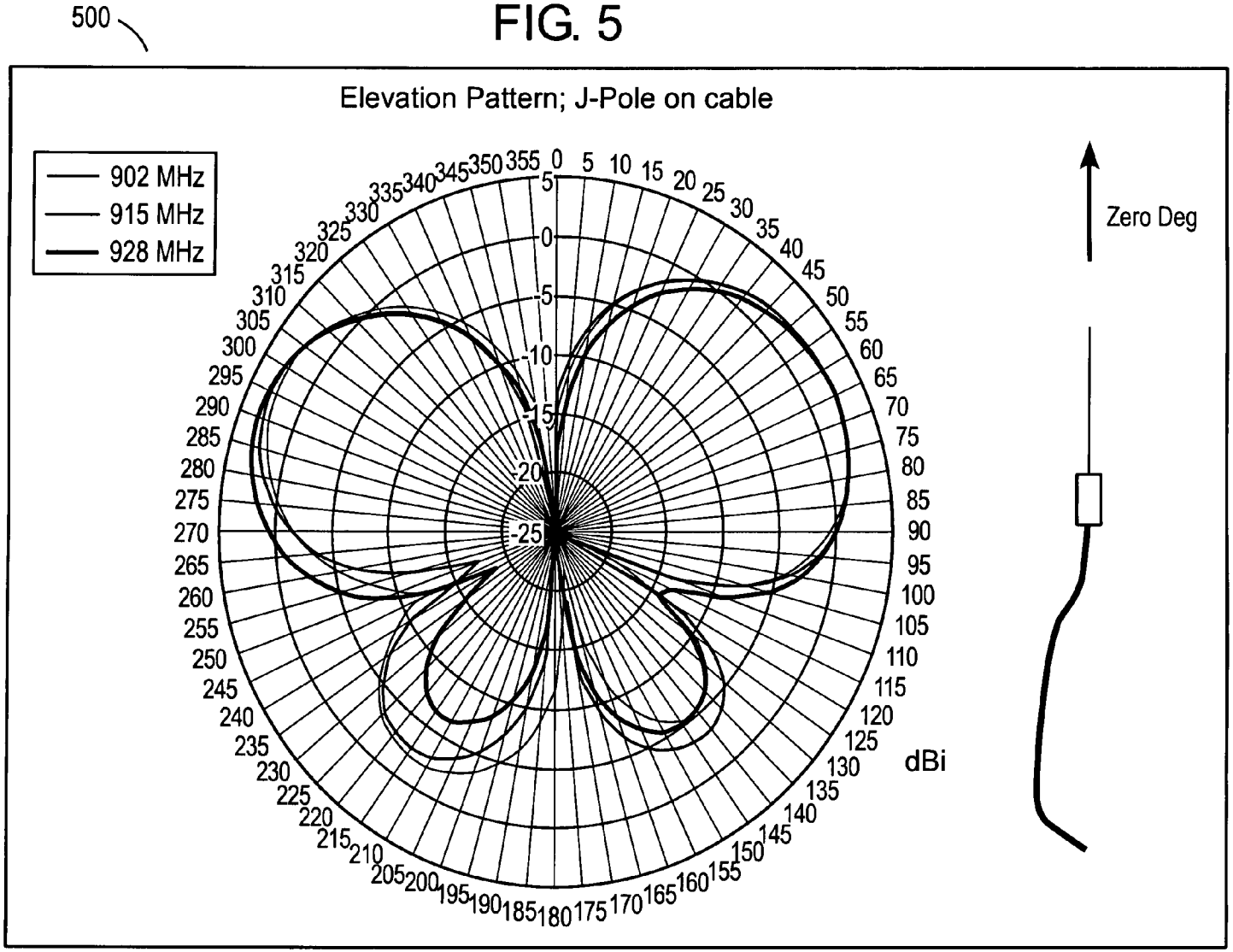
FIG. 5 graphical illustration of an antenna pattern of one possible embodiment of a J-pole antenna.

FIG. 5 shows the measured antenna pattern 500 for the J-Pole antenna design according to the features described in this embodiment. Patterns for three frequencies are shown: 902 MHz, 915 MHz (center frequency), and 928 MHz. This frequency band is used by wireless networks offering AMR services. For those skilled in the art, it is immediately obvious that the achieved radiation performance with this design is unchanged The invention has been described with reference to particular embodiments. However, it will be readily apparent to those skilled in the art that it is possible to embody the invention in specific forms other than those of the preferred embodiments described above. This may be done without departing from the spirit of the invention. Thus, the preferred embodiment is merely illustrative and should not be considered restrictive in any way. The scope of the invention is given by the appended claims, rather than the preceding description, and all variations and equivalents which fall within the range of the claims are intended to be embraced therein.

What is claimed is:

1. An antenna, comprising:

a connector including a feed line and a ground line, and an antenna segment formed from a single conductive material and securely connected to the connector, the antenna segment formed to include:

a radiating antenna segment, the radiating antenna segment electrically connected to the feed line at a feed line connection point, a non-radiating matching segment substantially parallel to the radiating antenna segment, the non-radiating matching segment substantially shorter than the radiating segment, the non-radiating matching segment electrically connected to the ground line at a ground line connection point, and a shunt segment electrically connected to the non-radiating matching segment, the shunt segment formed between the feed line connection point and the ground line connection point, wherein the shunt segment, the radiating antenna segment, and the non-radiating matching segment are all positioned on a common side of the feed line connection point.

2. The antenna of claim 1, wherein the shunt segment is formed as a bend in the conductive material.

3. The antenna of claim 1, further comprising a connector plate, providing the ground, and that provides a secured opening for the feedline connector, but electrically isolated from the feedline.

4. The antenna of claim 3, wherein the connector is a coaxial type connector.

5. The antenna of claim 4, wherein the shunt segment is formed as bend in the conductive material extending away from the connector plate.

6. The antenna of claim 5, wherein the shunt segment forms a loop which is substantially parallel to the radiating antenna segment and the matching segment.

7. The antenna of claim 3, further comprising an antenna enclosure attached to the connector plate and formed to enclose the matching segment, the antenna enclosure including a radiating antenna segment opening positioned to allow the radiating antenna segment to extend from the antenna enclosure.

8. The antenna of claim 7, wherein the radiating antenna segment is a removable segment.

9. The antenna of claim 1, wherein the radiating antenna segment is a telescoping segment.

10. The antenna of claim 1, further comprising an electronic device enclosure attached to the antenna and formed to enclose the matching segment and an electronic device, the electronic device enclosure including a radiating antenna segment opening positioned to allow the radiating antenna segment to extend from the electronic device enclosure.

11. The antenna of claim 10, wherein the radiating antenna segment is a foldable unit and includes a pivot joint securely attached between an upper radiating segment and a lower matching antenna segment such that the upper radiating segment may be moved between a position in line with the lower matching segment and a position out of line with the lower radiating segment.

12. The antenna of claim 10, wherein the radiating antenna segment includes a removable segment.

13. The antenna of claim 1, wherein the antenna is for use as a radiating element in a fixed RF communication network.

14. The antenna of claim 1, wherein the antenna is for use as a radiating element in a wireless communication network.

15. A J-Pole antenna comprising:

a radiating antenna segment;

a feed line connector for connecting the radiating antenna segment to a feed line;

a matching segment having an arm parallel to the radiating antenna segment;

a ground line connector for connecting the matching segment to a ground line; and a shunt segment connected to the radiating antenna segment and the matching segment at the feed line connector and the ground line connector, respectively, wherein at least a portion of the shunt segment extends away from the plane formed by the radiating antenna segment and the matching segment, and forms a loop parallel to the plane formed by the radiating antenna segment and the matching segment.

16. The J-Pole antenna of claim 15, wherein the J-Pole antenna is formed from a single piece of conductive tubing.

17. The J-Pole antenna of claim 15, wherein the J-Pole antenna is for use as a radiating element in a fixed RF communication network.

18. The J-Pole antenna of claim 15, wherein the J-Pole antenna is for use as a radiating element in a wireless communication network.

19. The J-Pole antenna of claim 15, wherein the shunt segment, the radiating antenna segment, and the matching segment are all positioned on a common side of the feed line connector and the ground line connector.

20. An antenna, comprising:

a connector including a feed line and a ground line, and an antenna segment formed from a single conductive material and securely connected to the connector, the antenna segment formed to include:

a radiating antenna segment, the radiating antenna segment electrically connected to the feed line at a feed line connection point, a non-radiating matching segment substantially parallel to the radiating antenna segment, the non-radiating matching segment substantially shorter than the radiating segment, the non-radiating matching segment electrically connected to the ground line at a ground line connection point, a shunt segment electrically connected to the non-radiating matching segment, the shunt segment formed between the feed line connection point and the ground line connection point, and a connector plate, providing the ground;

wherein the shunt segment is formed as bend in the conductive material extending away from the connector plate.

21. The antenna of claim 20, wherein the shunt segment, the radiating antenna segment, and the non-radiating matching segment are all positioned on a common side of the feed line connection point.

* * * * *